US006449937B1

(12) United States Patent
Galan I Llongueras

(10) Patent No.: US 6,449,937 B1
(45) Date of Patent: Sep. 17, 2002

(54) PROCESS FOR OBTAINING A THREAD FOR MANUFACTURING SPECIAL FABRICS AND SYSTEM FOR IMPLEMENTING SAID PROCESS

(75) Inventor: Jordi Galan I Llongueras, Terrassa (ES)

(73) Assignee: Galan Int. S.L., Barcelona (ES)

( * ) Notice: Subject to any disclaimer, the term of this patent is extended or adjusted under 35 U.S.C. 154(b) by 0 days.

(21) Appl. No.: 09/719,254

(22) PCT Filed: Mar. 28, 2000

(86) PCT No.: PCT/ES00/00113

§ 371 (c)(1),
(2), (4) Date: Feb. 2, 2001

(87) PCT Pub. No.: WO00/61843

PCT Pub. Date: Oct. 19, 2000

(30) Foreign Application Priority Data

Apr. 8, 1999 (ES) ..... 9900723

(51) Int. Cl.[7] ..... D02G 3/38
(52) U.S. Cl. ..... 57/6; 428/15

(58) Field of Search ..... 57/200, 210, 224, 57/225, 3, 1 R, 6; 428/15, 16, 17

(56) References Cited

U.S. PATENT DOCUMENTS

| | | | | |
|---|---|---|---|---|
| 4,077,752 A | | 3/1978 | Zahn | |
| 4,155,790 A | * | 5/1979 | Galloway | 156/149 |
| 4,164,841 A | | 8/1979 | Borenstein et al. | |
| 4,607,481 A | * | 8/1986 | Bell et al. | 57/3 |

FOREIGN PATENT DOCUMENTS

| | | |
|---|---|---|
| EP | 0432272 A1 * | 6/1991 |
| ES | 8501017 | 2/1985 |
| GB | 670951 | 4/1952 |

* cited by examiner

*Primary Examiner*—Danny Worrell
*Assistant Examiner*—Shaun R Hurley
(74) *Attorney, Agent, or Firm*—Merchant & Gould P.C.

(57) ABSTRACT

The invention relates to a continuous process for obtaining a thread or strand, made of a plastic or textile material for manufacturing special fabrics, particularly artificial grass, comprising extrusion of a plastic material to obtain a given strand or flat thread and a helicoidal winding section. The extrusion and winding sections operate synchronically.

3 Claims, 1 Drawing Sheet

Figure 1:
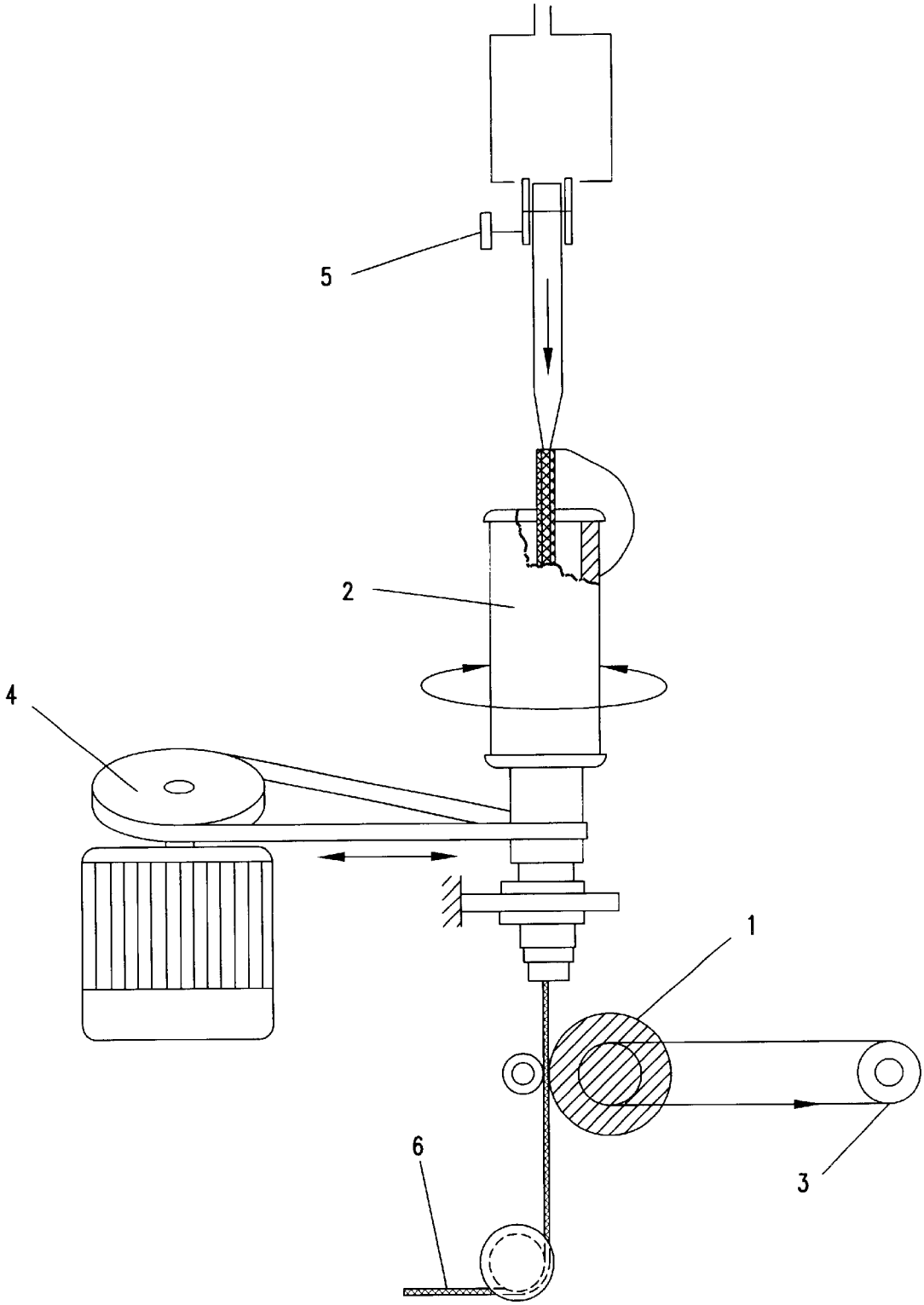

PROCESS FOR OBTAINING A THREAD FOR MANUFACTURING SPECIAL FABRICS AND SYSTEM FOR IMPLEMENTING SAID PROCESS

DESCRIPTION

The present invention refers to a process for getting yarn or cord made of plastic or textile material that will be used for the outfitting of special fabric, specially artificial grass, fully used in sports facilities such as golf fields, tennis courts, athletic stadiums and others. In the same way, the present invention refers to a specifically developed system for the continuous and efficient fulfillment of the process mentioned, avoiding interruptions and discontinuities in this process with the purpose of improving the process eficiency, thus reducing the manufacturing costs. A third objective of this invention refers to a yarn or cord with circular cross-section produced by the system of the invention and through the application of the process of the invention.

Nowadays, the process used normally to obtain basic cord or yarn for the outfitting of special fabric and specially of artificial grass is discontinuous, which involves the use of a synchronized stage system, that has the following stages:

a) Extrusion/fibrillation of a heat-stable plastic material to get a rectangular cross-section profile, in strip or flat yarn form, by means of an extrusion mould with the appropriate shape to fit the wanted dimensions;

b) winding of the mentioned flat yarn around a drum, the winding speed being fixed by the flat yarn production speed;

c) transportation of the complete bobbin obtained in b) to the machine that will make the next stages;

d) twisting, by means of a twisting machine, of the flat yarn obtained in a) to get a helicoidal cord suitable for the following outfitting of the special fabric, particularly the artificial grass;

e) final winding of the yarn obtained in the twisting stage, for its sending to the final product outfit plant. This stage can sometimes be included on stage d).

With the purpose of making available a continuous manufacturing process, keeping the same product quality and output productivity, it has been developed a "non-twisted" yarn by means of a spiral-winding (with a convolution of P mms.) with a very fine monofilament made of polyamid or similar plastic material, to the aim of converting the flat yarn coming from the extrusion stage into a circular cross-section yarn.

The system of the invention for getting the said yarn produces the creation of a continuous process, also an object of the present invention, that avoids any interruption and that joins all the process stages in only one facility, thus saving transportation times and waiting times as well as costs.

The process object of the present invention has three stages:

a) Extrusion/fibrillation of a plastic material to get a flexible, rectangular cross-section, profile in stripe or flat yarn form, by means of an extrusion mould with the appropriate shape to fit the wanted dimensions. This stage is the same as the one used in the existing processes;

b) curving of the flat yarn by means of the wrapping around it one or more threads of plastic material, preferably polyamide, thus obtaining a helicoidal configuration of the group formed by the strip and the wrapping thread or threads, the mentioned wrapping being made by means of the turning of one or more synchronized bobbins around the flat yarn that comes out directly from the extrusion, thus obtaining a circular cross-section cord for the further outfitting of the basic fabric for the manufacturing of the special fabric and especially the artificial grass; this curving-wrapping operation differs substantially from the twisting applied in the existing processes because the cord is formed by the curving of the strip or flat yarn coming from the extrusion and by helicoidal wrapping of the said strip or flat yarn with thread or threads of plastic material, preferably polyamide.

c) Final winding of the yarn or cord obtained in the b) stage for its sending to the final product outfitting plant. This winding stage is the same as the one used in the existing processes.

As can easily be understood from the analysis of the improved process of the invention, it has been possible to eliminate the b) and c) stages from the existing processes. The stage b) of the process of the invention is made by the system of the invention in a synchronized way with the extrusion stage a).

The system of the invention has two sections, the first one consisting of an extrusion device to obtain, from a thermoplastic material piece, a rectangular profile in flat strip form, and the second section that is formed by a tractor/stretcher or pulling device, the pulling speed of which is higher than the feed rate of the extrusion device, and also by a winding device comprising one or more drums that turn around the strip, winding some threads, preferably of polyamide, to get a helicoidal configuration of the final product formed by said strip wrapped by the thread or threads supplied by the mentioned drum or drums. The pulling device and the winding device work in an independent but synchronized way in relation to the output speed of the extrusion device, with the objective of avoiding possible errors that could affect the performance of the system and also the final product quality. This synchronization is reached by any of the synchronization methods known in the present state of the art.

For a better understanding of the characteristics of the invention, a preferred embodiment will now be described, as an example non limiting the scope of the invention and referred to the enclosed FIG. 1 that shows schematically the system of the invention.

In this embodiment the pulling device (1) driver and the winding device (2) driver are independent although they work synchronized. The driving of the pulling device (1) is performed by a conventional electric motor (3), and the driving of the winding device (2) is carried out by means of a different electric motor (4) with an speed electronic variator device controlled by a sensor (5) that detects any variation of the displacement speed of the strip at the exit of the extrusion stage. This way, the two sections are synchronized, reaching the objective that in the winding stage of the flat strip there are no errors that could affect the quality or the aspect of the final product (6). This final product presents a helicoidal traverse section.

Once described in detail the nature of the present invention, it must be stated that any changes can be made provided that they do not affect the characteristics of the invention according to the following claims.

What is claimed is:

1. Process to produce yarn or cord of plastic material adequate for manufacturing special fabric, the process comprising the steps of:

extruding a plastic material to obtain a strip or a flat yarn;

conforming said strip or flat yarn by helicoidally wrapping one thread or a plurality of threads of plastic or textile material around said strip after said step of extruding, wherein said yarn or cord comprises a core of curved, non-twisted, strip or flat yarn helicoidally wrapped by a winding consisting of one or a plurality of threads of polyamide or other plastic material.

2. System for manufacturing or cord of plastic material adequate for manufacturing special fabric, comprising:

a first section consisting of an extrusion device to obtain a rectangular profile in flat strip form;

a second section consisting of a traction/stretcher or pulling device whose pulling speed is higher than the feed rate of the extrusion device and a winding device having one or a plurality of drums turning around said strip, each providing a thread of polyamide or other plastic material to be wound on said strip.

3. The system for manufacturing yarn or cord of plastic material adequate for manufacturing special fabric, according to claim 2, wherein said pulling device is driven by a first electric motor, said winding device is driven by a second electric motor having a speed electronic variator device controlled by a sensor detecting speed variations of said strip exiting from said extrusion device and wherein as a result of the first motor turning and the second motor turning, working synchronized, a continuous yarn or cord is produced.

* * * * *